United States Patent [19]

Augier et al.

[11] 4,102,618

[45] Jul. 25, 1978

[54] MANUFACTURING BENCHES FOR MOULDED CONSTRUCTION

[75] Inventors: Robert Joseph Ernest Augier, Sorgues; Jean Marc Eliche, Les Angles, both of France

[73] Assignee: Societe Anonyme de Recherche et d'Etudes Techniques, France

[21] Appl. No.: 741,135

[22] Filed: Nov. 11, 1976

[30] Foreign Application Priority Data

Nov. 17, 1975 [FR] France ..... 75 35018

[51] Int. Cl.[2] ..... B28B 7/06

[52] U.S. Cl. ..... 425/64; 249/118; 249/128; 249/161; 264/334; 425/96; 425/219; 425/227; 425/289; 425/436 R; 425/441

[58] Field of Search ..... 249/66, 118, 128–129, 249/161; 425/89, 90, 96, 101, 219, 231, 259, 289, 311, 436, 441; 264/316

[56] References Cited

U.S. PATENT DOCUMENTS

| | | | |
|---|---|---|---|
| 551,205 | 12/1895 | Gibson | 425/101 |
| 1,631,697 | 6/1927 | Scherdel | 425/101 |
| 3,152,361 | 10/1964 | Edwards | 425/89 |
| 3,183,287 | 5/1965 | Fischer | 425/311 |
| 3,224,064 | 12/1965 | Hummel et al. | 425/63 |

FOREIGN PATENT DOCUMENTS

| | | | |
|---|---|---|---|
| 2,153,742 | 4/1973 | France | 249/129 |
| 1,134,327 | 8/1962 | Fed. Rep. of Germany | 425/436 |

OTHER PUBLICATIONS

Russian Author Certificate No. 83,192; 1950.

Published French Application No. 72-33575; 9/15/1972; André Blanquet.

*Primary Examiner*—Francis S. Husar

*Assistant Examiner*—John McQuade

*Attorney, Agent, or Firm*—Kane, Dalsimer, Kane, Sullivan and Kurucz

[57] ABSTRACT

A manufacturing bench for molded construction elements is disclosed comprising molds whose bottom walls are defined by an elongated table and whose lateral walls are constituted at least in part by flexible blades placed edgewise on the table which are held taut. The lateral walls are longitudinally displaceable.

14 Claims, 14 Drawing Figures

MANUFACTURING BENCHES FOR MOULDED CONSTRUCTION

BACKGROUND OF THE INVENTION

1. Field of the Invention

This invention has for its object improvements in manufacturing benches for molded construction elements.

2. Description of the Prior Art

Methods are known for manufacturing construction elements made of a mixture of an inert charge and of a binding compound such as cement concrete or resin concrete by extrusion, drawing or molding.

Molding processes are generally preferred to extrusion or drawing processes because of the greater precision obtainable with respect to the elements which are made. However, and especially for the manufacture of small size elements, molding methods are relatively expensive because they require an important investment in equipment, on the one hand, and on the other hand because they require a relatively long manufacturing cycle. The manufacturing cycle is long since, after the first element or series of elements has been molded, the rigid molds must be separeted from the molded elements, cleaned and positioned anew after adjustment, for the manufacture of another or of another series of elements.

It has already been suggested, in order to obviate the above mentioned drawbacks, to perform a molding method on a manufacturing bench comprising an elongated shaped table having molds whose lateral walls are defined by flexible blades stretched edgewise along the entire length of the table, said blades being lifted away from the table during the unmolding operation. However the removal and positioning of blades of great length by movements perpendicular to their longitudinal direction, said blades having moreover to be held taut when they rest on the table of the bench, create difficulties which complicate to a considerable degree the working of said bench to a considerable degree.

SUMMARY OF THE INVENTION

It is an object of this invention to provide improvements to benches for the manufacture of molded elements of the above defined type which render their use much simpler.

It is also an object of this invention to provide an improved bench for the manufacture of molded elements to having high dimensional accurateness, in a short manufacturing cycle so that the efficiency of the bench is increased in the same proportion.

It is thus an object of this invention to provide an improved bench which is adapted for use in the manufacture of elements whose shapes differ from one another, for instance the cross-sections of beams or girders.

It is yet another object of this invention to provide improvements easily adapted to existing benches, especially those for manufacturing prestressed concrete elements.

A bench for the manufacture of molded construction elements comprising molds whose bottom walls are defined by an elongated table and whose lateral walls are defined at least in part by flexible blades, disposed edgewise, which are held taut, is, according to this invention, characterized in that it comprises means for moving said lateral walls in a direction which is longitudinal with respect to their orientation.

According to another feature of this invention, the lateral walls of the molds are secured at one of their ends to a drum around which the said walls can be rolled up, immediately after casting of the material to be molded, that is, before the binding compound has "gelified", after the compound has gelified, but before the material has completely set, or after hardening of the said material.

In the latter case, the step of moving said walls in their longitudinal direction with or without rolling up onto a drum, is preferably preceded by an operation intended to slightly space the lateral walls of the molds away from the molded elements to facilitate the subsequent relative movement of said lateral walls relative to said elements, which can then be moved away from the bench after having been grasped by an appropriate lifting apparatus or alternatively, after having been brought below the level of the table when the table comprises a downwardly displaceable flooring.

An improved bench improved according to this invention is advantageously used either in the manufacture of reinforced concrete elements, that is with longitudinal reinforcing structures, or in the manufacture of elements made of concrete reinforced with fibreglass, metal fibres or similar reinforcements disposed in a random fashion throughout bulk thereof, or in the manufacture of prestressed concrete elements.

BRIEF DESCRIPTION OF THE DRAWINGS

The invention will be better understood by the following description given by way of example and with reference to the accompanying drawings wherein.

DETAILED DESCRIPTION OF THE INVENTION

The bench of the invention is used for the manufacture of molded construction elements made from a mixture of an inert charge and of a binding compound such as cement or, resin concrete, plaster etc., subsequently reinforced by fiberglass structures (rods) or metal fibres disposed in a random fashion in the bulk thereof; or from concrete reinforced with longitudinal elements, prestressed or not. This invention provides for a bench comprising a table 10, FIG. 1, made of sheet steel, concrete or of any other material suitable for the bottom wall for a mold. The table 10 may be equipped with vibrating devices, as well as with heating means. It rests on a foundation 11, which, in certain embodiments, enables downward displacement of moveable portions of the table. Alongside the table, on both sides of its longitudinal mean plane extend two sectional rails one of which is shown in 12, FIG. 2.

Figures 2, 2A, 2B, 2C, 2D, 2E, 2F, 2G, 7:
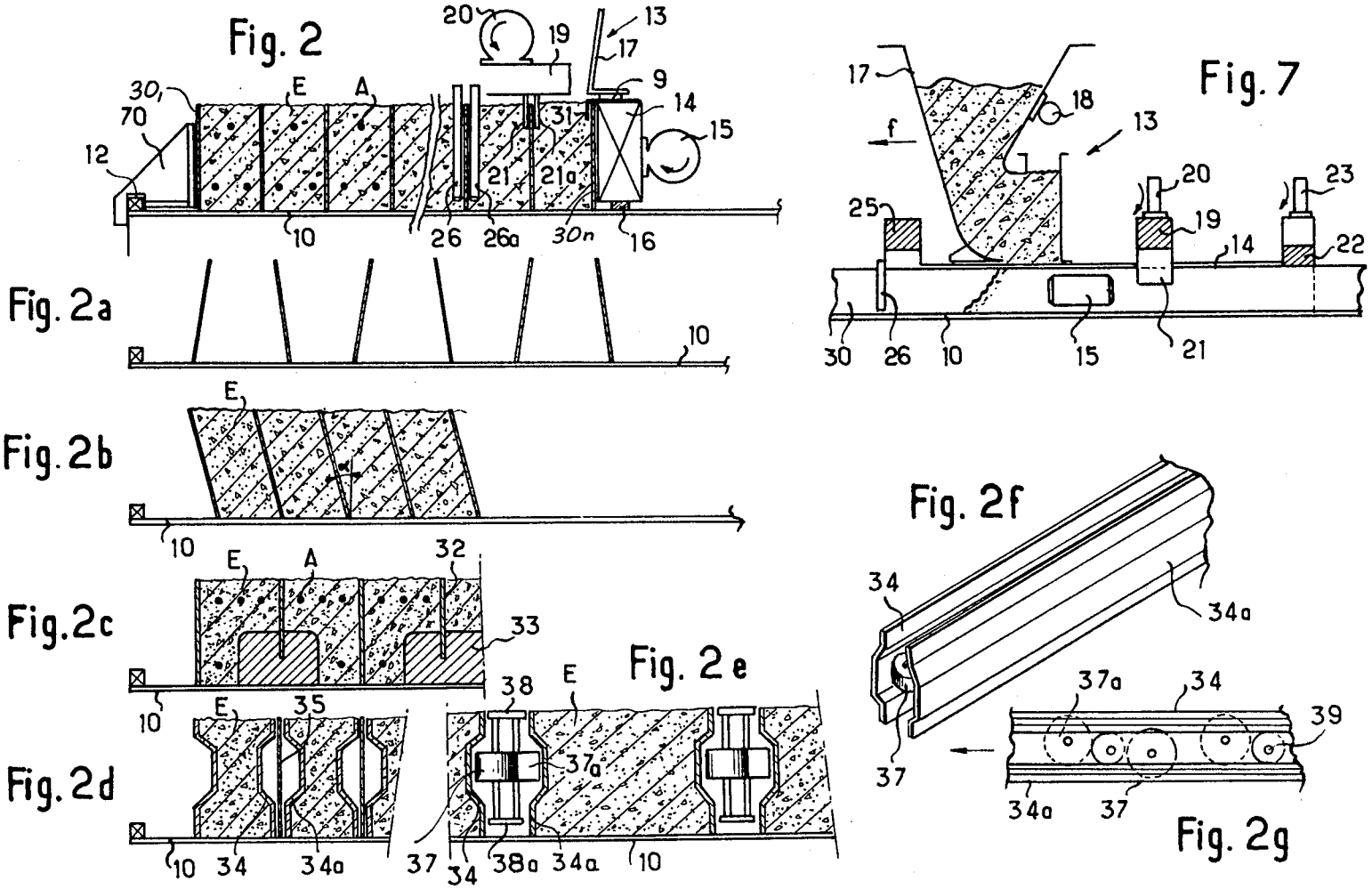
FIG. 2 is a partial front cross sectional view of the apparatus of the invention.
FIG. 2*a* is a view similar to that of FIG. 2, but in less detail and for another arrangement of the lateral walls of the molds.
FIG. 2*b* is a view similar to that of FIG. 2*a* having yet a different arrangement of lateral walls.
FIG. 2*c* is a view similar to those of FIGS. 2*a* and 2*b* for forming elements of a particular shape.
FIG. 2*d* is a view similar to those of FIG. 2 having specially designed blades.
FIG. 2*e* shows an alternative embodiment of the lateral walls of the molds of a bench according to this invention.
FIG. 2*f* is a schematical perspective view of the lateral walls of the molds shown in FIG. 2*e;*
FIG. 2*g* is a top view of the walls of the molds shown in FIGS. 2*e* and 2*f;*
FIG. 7 is a schematical elevational view of a feeding hopper for the material to be molded.

Said rails define the rolling path of a machine 13 shown schematically on the right hand side of FIG. 2 and in FIG. 7, which serves, in particular to distribute the material to be molded into the construction elements.

The machine 13 comprises a chassis 14 the lateral faces of which carry vibrators 15 adapted to impart vibrations to the table 10 by means of transmission members 16. On the chassis 14 is resiliently supported, by means of studs 9, a constant level tub 17 equipped with wall vibrators 18. The machine 13 which moves on the rails 12 in the direction of the arrow *f*, FIG. 7, comprises at the back of the tub 17, in its direction of motion, a ruler 19 for levelling the material poured from the tub. The ruler is topped with a vibrator 20 and which carries on its lower face small lips 21 and 21*a* whose role will be subsequently explained. Besides the levelling ruler 19 mounted in a resilient manner onto the chassis 14, the latter carries also behind the ruler 19 a finishing ruler 22 topped with a vibrator 23. In front of the tub 17, the machine 13 is provided with fingers 26 and 26*a* which downwardly depend from cross-bar 25, of greater length than the small lips 21 and 21*a* as well as devices, known per se, for maintaining reinforcements A imbedded at required height and in alignement within the elements E being molded on the bench, when such reinforcements are present.

Said elements E, which may for instance be beams or girders with rectangular, square, trapezoidal, I,U,T,L etc. shape cross-sections, small posts, longitudinal beams, structure elements, small flagstones, border elements, purlins, security sliding elements, etc. are molded between the table 10 and the lateral walls of molds 30, which comprise or are constituted by flexible elements such as blades, planar or sectional, disposed table 10 along their edges. The number of blades is equal to the number of elements manufactured plus one.

In the simpler embodiments, shown in FIGS. 2, 2*a* and 2*b* which relate to the manufacture of elements with rectangular cross-section, of elements with trapezoidal cross-section and of elements such as covering purlins the inclination $\alpha$ of which corresponds to the slope of the covering respectively. The lateral walls 30 are constituted by flexible metal blades, held taut during casting of the material forming the elements. The pair of small lips 21 and 21*a* of the ruler 19 and the fingers 26 and 26*a* of the cross-bar 25, cooperate with the metal blades by riding upon them. The margin blades $\mathbf{30}_l$ and $\mathbf{30}_n$ of the set of blades, FIG. 2, are topped by corner pieces such as 31 which are integral with the chassis 14. In the embodiments according to FIGS. 2*a* and 2*b*, the fingers 26 and 26*a* as well as the small lips 21 and 21*a* are non-vertical.

In the embodiment according to FIG. 2*c*, showing the manufacturing of beams or girders with L cross-section for resisting compounded flexion, the lateral walls of the molds 30 are constituted by flexible planar metal blades, of varying widths, the blades of lesser width 32, being inserted by their lower portions into cores 33 placed onto the table 10, whereas the other blades 30 rest directly on said table.

In the embodiment shown in FIG. 2*d*, the lateral walls of the molds are constituted by flexible sectional metal blades 34 and 34*a* which, with the exception of the margin blades are associated in pairs, with mirror symmetry, with an intermediate planar blade 35 located between each pair of such blades.

In the embodiment shown in FIGS. 2*e* to 2*g* the lateral walls of the moulds are constituted by sectional flexible metal blades having same cross-section as that of blades 34 and 34*a*, i.e. with trapezoidal central portion and planar end portions. In this embodiment however, the sectional blades 34 and 34*a* are not adjacent on each side of a central planar blade but comprise two trains of rollers 37 and 37*a* between them. The rollers are arranged with vertical shafts integral with chains 38 and 38*a* which extend parallel to the table 10 and which are linked at points such as 39, FIG. 2*g*.

Figures 1, 3, 4, 5, 6:
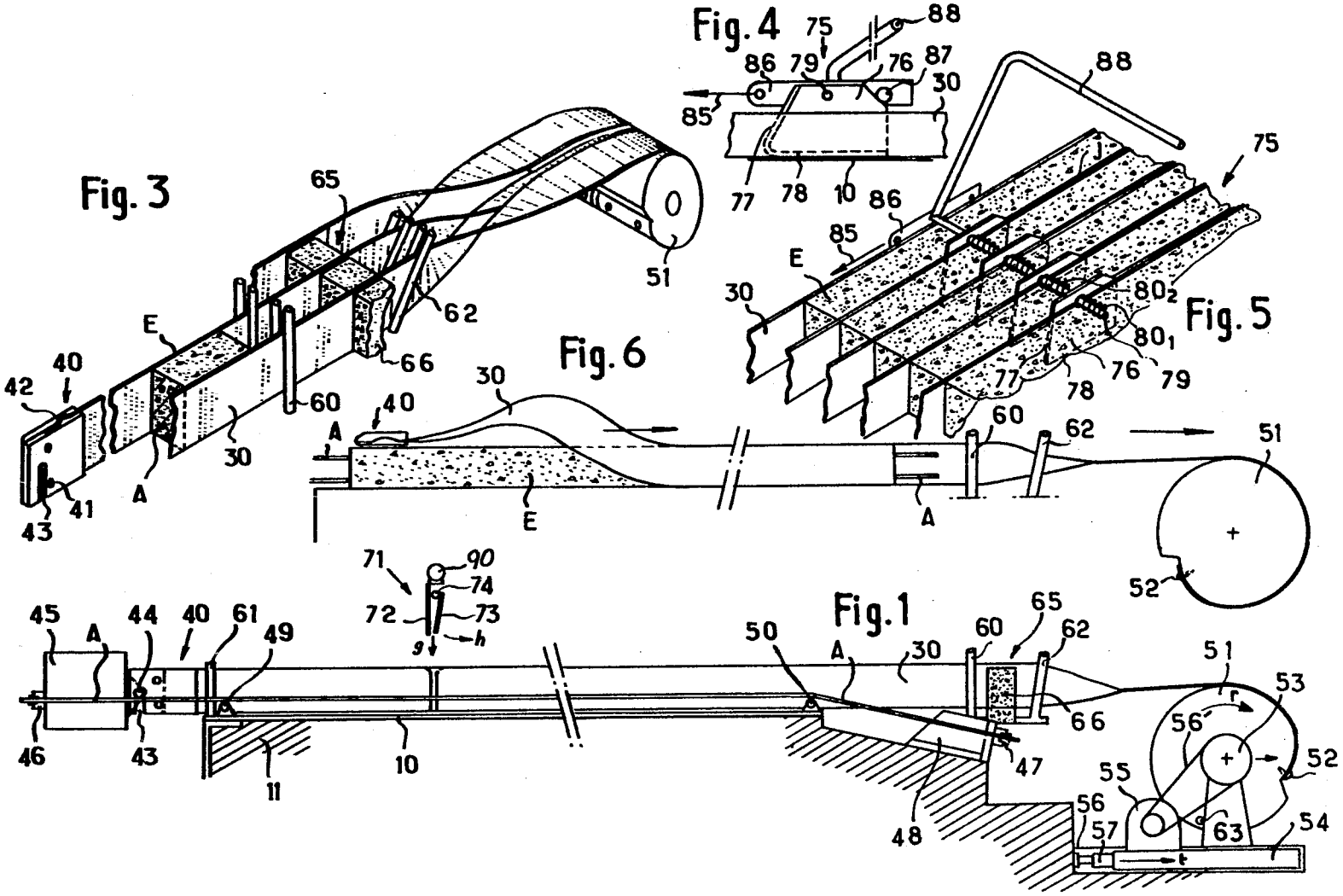
FIG. 1 is a schematic side view of an improved bench according to this invention.
FIG. 3 is a perspective view of a portion of a bench according to the invention.
FIG. 4 is a lateral view of an instrument suitable for use with a bench according to this invention.
FIG. 5 is a perspective view of the instrument shown in FIG. 4.
FIG. 6 shows removal of the blades according to the invention.

Whatever the embodiment of the lateral walls of the molds, some of which have been described immediately above in a non limiting fashion, it is important that said lateral walls comprised or formed out of flexible elements lying edgewise on said table 10 be held or maintained taut at least during the casting of the material such as concrete or the like distributed by the machine 13. To this end, the invention provides for the insertion of the end of each one of said blades 30, with or without a fold 42, into a covering 40 made of two parts fixed to one another by means of screws 41, FIGS. 1 and 3. The covering 40 has thereon a notch 43 so that is may be removably attached, by means shown schematically as 44 in FIG. 1, to a traction head 45. The latter is preferably the tightening head for the reinforcements A which are clamped on the head by means of jaws 46. The reinforcements are maintained at their other ends by moorings 47 which moor the reinforcements to a fixed frame 48. Elements A are positioned on the table 10 by rollers shown schematically in 49 and 50. At the end of the blade distant from that clamped by covering 40, each blade is twisted 90°. As shown in FIG. 3, the blades roll to a drum 51 onto which it is secured, for instance, by means of screws 52. The rotation of drum 51 in the direction reverse to that of the arrow *r* is prevented by means of a displaceable stop 63. The roll is linked to a winch 53 the frame 54 of which, FIG. 1, carries a motor-reducer group 55 driving the winch 53 by means of a transmission 56'. The frame 54 is slideably mounted in fixed slides 56 anchored into the foundation 11, and can be moved by action of hydraulic or mechanical jacks 57.

The frame 48 carries, fixed, vertical fingers 60 for guiding the flexible blades, as well as fingers 62 inclined by approximately 30°. These latter fingers facilitate the twisting of the blades beyond the operative region of the bench, in such manner that no difficulty is encountered when operating the latter, in particular for the reinforcing operation of the products to be molded. Between the fingers 60 and the drum 51, preferably between the fingers 60 and 62, are provided means 65 for the cleaning and greasing the flexible blades. Means such as for instance blocks 66 made out of a special felt saturated with oil, preferably carried by the fixed frame 48 are provided whose cross-section is substantially that of the elements E to be molded.

At its end remote from the frame 48, the bench carries fixed vertical fingers 61 placed so as to correspond with the fingers 60.

The manufacture of the elements E is conducted in the following way:

After placing the reinforcement members A in position on the bench, the flexible blades 30-32-34 are in turn positioned along the length of the bench between the fingers 60 and 61. When the reinforcements A have been tightened by means of the movable head 45, the coverings 40 are attached on said head by means 44. The frame 54 is then caused to move in the direction of the arrow *t* by actioning of the jacks 57 in order to effect the tightening of the flexible elements forming the lateral walls of the molds. The lateral walls defining together with the table 10 a plurality of parallel "channels" whose cross-section is as shown in FIG. 2, or 2*a* or 2*d*.

The machine 13, initially at the end of the bench towards the fixed frame 48 is started and the material to be molded, for instance concrete, is regularly distributed by means of the tub 17, the vibration of the table 10 is also begun. During the movement of the machine 13, the flexible side elements $30_l$ and $30_n$ are accurately guided and positioned by means of sectional parts such as 31 which are integral with the chassis 14. The fingers 26 and 26*a* ensure this same positioning and guiding for the blades 30 disposed between the side blades. After distribution of the material to be molded, the ruler 19 provides for the levelling and the satisfactory filling of the molds, both by virtue of its own vibration which is communicated thereto by means of the vibrator 21, and by the vibration it communicates to the flexible blades by means of the small lips 21. The ruler 22 which is acted upon by of the vibrator 23 finishes off of the surface of the cast material.

After the filling of the molds, wedges 70, FIG. 2, placed on the rails 12 along the table 10 maintain the flexible margin blades $30_l$ and $30_n$ in place to ensure precise dimensioning of the manufactured elements. The precision is further contributed to by the positioning of the blades by means of sectional parts 31 and the fingers 26, 26*a* of the machine 13, rolling upon the rails 12, which constitute the alignment reference.

When the length of the elements to be manufactured is such that each mold contains a plurality of elements which will be subsequently severed, it is contemplated to pre-cut said elements while the cast material is still fresh. This may preferably be done by means of a vibrating trimmer 71 comprising two combs 72 and 73 which fit between the lateral walls 30 of the molds and the reinforcements A. The combs 72 and 73 are preferably pivotally joined about a horizontal axis 74. After the introduction of the trimmer 71 in the cast material, illustrated by arrow *g* in FIG. 1, during which the lower ends of combs 72 and 73 are brought together, said combs can be set apart by a rotation of comb 73, as shown by arrow *h* in FIG. 1, in order to widen the cut made in the cast material. The trimmer is operated in connection with a vibrator 90 to facilitate its engagement in the fresh cast material operated by the vibrator 90.

The lateral unmolding is effected as a function of and according to the nature of the elements manufactured. In a first utilizing mode of the bench the unmolding operation is effected before hardening of the material, before or after "gelification" of said material. In such a case the coverings 40 having no fold 42 are separated from the blades 30, the motor-reducer 55 is started, the winch 53 drives the drum 51 in the direction of the arrow *r* to roll up the flexible blades 30 onto said drum. The flexible blades 30 which slide between the as yet not hardened elements E. Before being rolled up onto the drum, the flexible blades pass between the felt blocks 66 and are thus cleaned so that they may be re-used later on. Depending on the width of the flexible blades 30, adjacent blades roll up onto the drum 51 with mutual overlapping, as shown in FIG. 3, so that the length of the drum is substantially equal to the width of the bench.

When the lateral walls of the molds have the structure shown in FIG. 2*d*, one proceeds with the central planar blade 35 as described hereinabove, the removal of which is effected without any difficulty. The friction, blade upon blade being less than the friction between blade and molded product. Thus any motion of the forms 34 and 34*a* of the molds relative to the cast material is prevented. The extraction of said forms is effected afterwards, after hardening of the material, either by translational movement or by rolling onto a large radius drum.

When the lateral walls of the molds have the structure shown in FIGS. 2*e* to 2*g*, the unmolding is effected by first removing the chains 38 and 38*a*, for instance attached to the machine 13. Parallelepipedic liners are introduced from place to place in the empty space left between the forms 34 and 34*a*, which prevent the falling over of said forms before setting and hardening of the molded material. After hardening, the forms 34 and 34*a* are removed by translational movement and/or rolling up onto a large radius drum.

In a second, more general, mode of utilisation, the unmolding takes place after hardening of the cast material. In this case, the tension of the reinforcements A is first relaxed by displacement of the moveable head 45, displacement which causes also the releasing of the flexible blades defining the lateral walls of the moulds. An instrument 75 is then brought onto the bench, FIGS. 4 and 5, comprising thin knives 76 sharpened on their front edge 77 and on their lower edge 78 and which are assembled onto a transverse shaft 79 onto which are inserted springs $80_1$, $80_2$ . . . etc. These springs maintain said knives spaced from each other according to a spacing corresponding to that of the blades 30. For the displacement of the instrument 75, in the direction shown by the arrows in FIGS. 4 and 5, traction cables 85 are provided, one end of which is attached to a winch means not shown, and the other end of which is attached to lateral tie-bars 86 onto which is fixed a bar 87 which opposes the rotation of the knives 76 and a handle bar 88 maintained by a worker during the displacement of the instrument.

After the knives 76 of the latter have been inserted at one end of the bench between the elements E and the flexible blades 30, which may be done without any difficulty on account of the fact that the tension in the flexible blades has been relaxed, the displacement of the instrument 75 provides for a slight clearance of a few millimeters *j*, FIG. 5, between the molded elements E and the flexible blades 30.

The subsequent operation consists in rolling up the flexible blades onto the drum 51, after each one of the coverings 40 has been detached from the moveable head 45 and laid onto the hardened elements, as shown in FIG. 6. The rolling up of the flexible blades 30 onto the drum 51 which causes the simultaneous cleaning and greasing of the blades is effected as indicated hereabove and until the coverings 40 come into contact with the fingers 60.

When the casting of the material forming the molded elements has been followed by a trimming, the reinforcements A are cut up across the trimmed up regions. Subsequently some residual roughness is also cut away from the molded material across the trimmed up regions, and the molded elements are taken out, either towards the top, with conventional pliers, or towards the lower portion of the table 10, and in which case an appropriately designed foundation of the table is required.

The bench is then ready for the next manufacturing cycle which starts with the placement of reinforcements A, followed by their tightening, then by the placement of the lateral walls of the molds unrolled from the drum 51 by means of a winch not shown, provided at the end of the bench remote from said drum.

Alternatively, the lateral walls and the reinforcements A may be placed simultaneously.

Besides the advantages achieved by virtue of the precision of the manufactured elements, of the short duration of the manufacturing cycle, and of the low cost of the lateral walls of the molds, the improved bench according to this invention enables the reduction by a very significant proportion the idle time intervals existing in known manufacturing benches during a production change. In a bench according to this invention, it is sufficient to bring a drum 51 to one end of the bench on which are rolled flexible blades different from those initially implanted, and then to change the position of the fingers 60, 61 and 62, in order that a new manufacturing cycle may be initiated.

I claim:

1. A manufacturing bench for molded construction elements comprising: a plurality of molds having lateral walls and a bottom wall, said lateral walls comprising flexible blades having upper and lower edge portions and said bottom wall comprising an elongated table, said lateral walls being arranged such that the lower edge portions of said blades contact said table to form each of said molds, said lateral walls being secured at one of their ends to a drum for moving said walls in a longitudinal direction, a winch operatively associated with said drum, said winch being connected to motive means for driving said winch, said drum said winch and said motive means being slidably mounted at one end of said bottom wall and being operatively connected to jack means for maintaining said lateral walls taut.

2. A manufacturing bench for molded construction elements comprising: a plurality of molds having lateral walls and a bottom wall, said lateral walls comprising flexible blades having upper and lower edge portions and said bottom wall comprising an elongated table, said lateral walls being arranged such that the lower edge portions of said blades contact said table to form each of said molds, said bench further comprising traction means connected to said lateral walls for maintaining said lateral walls taut, and further comprising a machine operatively associated with said molds and movable above said molds for the distribution of the material to be molded into the molds formed by said table and said lateral walls, said machine being provided, on its front part, with fingers adapted to cooperate with said lateral walls and on its rear part with a ruler for levelling the said material to be molded, said ruler comprising vibrating means as well as small depending lips which ride in pairs upon opposite sides of the upper edge portions of said lateral walls and which are adapted to impart to said walls the vibrations exerted by said vibrating means.

3. A manufacturing bench for molded construction elements comprising: a plurality of molds having lateral walls and a bottom wall, said lateral walls comprising flexible blades having upper and lower edges, and said bottom wall comprising an elongated table, said lateral walls being arranged such that the lower edges of said walls contact said table to form each of said molds, said bench further comprising first means operatively connected to said lateral walls for maintaining said lateral walls taut and second means operatively connected to said lateral walls for moving said lateral walls in a longitudinal direction, said lateral walls each comprising two sectional blades being arranged in mirror symmetry to one another and having a flexible planar blade disposed between them.

4. A manufacturing bench for molded construction elements comprising: a plurality of molds having lateral walls and a bottom wall, said lateral walls comprising flexible blades and said bottom wall comprising an elongated table, said lateral walls comprising upper and lower edges being arranged such that the lower edges of said walls contact said table to form each of said molds, said bench further comprising first means operatively connected to said lateral walls for maintaining said lateral walls taut and further comprising second means operatively connected to said lateral walls for moving said lateral walls in a longitudinal direction, said lateral walls each comprising sectional blades disposed in mirror symmetry with respect to one another and which comprise between them rollers having vertical axes attached at their tops and bottoms to a horizontal chain which is movable relative to said blades.

5. A manufacturing bench for molded construction elements comprising: a plurality of molds having lateral walls and a bottom wall, said lateral walls comprising flexible blades comprising upper and lower edges and said bottom wall comprising an elongated table adapted to remain stationary during the molding operation, said lateral walls being arranged such that the lower edges of said walls contact said table to form said molds, said bench further comprising first means operatively connected to said lateral walls for maintaining said lateral walls taut and further comprising second means operatively connected to said lateral walls for moving said lateral walls in a longitudinal direction relative to said stationary table.

6. The bench of claim 5, wherein said lateral walls are made out of metal and are secured at one of their ends to said second means for moving said lateral walls in a longitudinal direction, said second means comprising a drum on which said lateral walls may be rolled.

7. The bench of claim 6, further comprising a winch adapted to rotate said drum, said drum and said winch being slidably mounted at one end of said bottom wall, said bench further comprising jacks operatively connected to said drum and said winch for moving said drum and said winch, said jacks comprising said first means.

8. The bench of claim 5, further comprising cleaning and greasing means arranged between said lateral walls for cleaning and greasing said walls when they are moved in a longitudinal direction.

9. The bench of claim 8, wherein said cleaning and greasing means comprise pads of felt saturated with oil for wiping said lateral walls while they are moved.

10. The bench of claim 5, further comprising an instrument located above said bottom wall, having parallel knives adapted to be introduced between said walls and said molded elements in direction of said bottom wall to create a clearance between said walls and said molded elements in order to facilitate the unmolding of the lateral walls of the molds and thus their longitudinal movement.

11. A bench as in claim 10, wherein said instrument having parallel knives is adapted so that it may be slid along the length of said lateral walls.

12. A bench of claim 5, further comprising a trimmer, located above said bottom wall having two combs pivotally mounted about a horizontal axis, and a vibrator, the introduction by a downwards motion towards said bottom wall of said trimmer into the freshly cast material insuring the separation of the casted material in a single mold.

13. The bench of claim 5, further comprising positioning fingers at each end of the elongated table for guiding said lateral walls.

14. A method of manufacturing molded construction elements in an apparatus having at least one mold having two lateral walls and a bottom wall, said lateral walls comprising flexible blades comprising upper and lower edges and said bottom wall comprising an elongated table adapted to remain stationary during the molding operation, said lateral walls being arranged such that the lower edge of said lateral walls contact said table to form said mold, said bench further comprising first means operatively connected to said lateral walls for maintaining said lateral walls taut and further comprising second means operatively connected to said lateral walls for moving said lateral walls in a longitudinal direction relative to said stationary table, said method comprising: adding material to be molded into said mold while said lateral and bottom walls are in a stationary position, waiting for said material to be at least partially cured, and removing said lateral walls from said elongated table by activating said second means to slide said lateral walls in a longitudinal direction relative to said stationary table.

* * * * *

UNITED STATES PATENT AND TRADEMARK OFFICE

CERTIFICATE OF CORRECTION

PATENT NO. : 4,102,618

DATED : July 25, 1978

INVENTOR(S) : Robert Joseph Ernest Augier and Jean Marc Eliche

It is certified that error appears in the above-identified patent and that said Letters Patent are hereby corrected as shown below:

At Col. 1, line 20, "important" should read --a sigificant--;
line 41, delete "to a considerable degree";
line 51, delete "to"; "accurateness" should read --accuracy--;

At Col. 3, line 35, delete "and";
line 55, after "disposed" insert --on--;
line 63, delete the period "." after "respectively" and change "The" to --the--;

At Col. 6, line 1 delete "operated by the vibrator";
line 2, delete "90";

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*